United States Patent [19]

Eisch et al.

[11] Patent Number: 5,063,083

[45] Date of Patent: Nov. 5, 1991

[54] PHOTOLYTIC DEPOSITION OF METAL FROM SOLUTION ONTO A SUBSTRATE

[75] Inventors: John J. Eisch, Vestal, N.Y.; Marek P. Boleslawski, Binghamton, N.Y.

[73] Assignee: The Research Foundation of the State University of New York, Albany, N.Y.

[21] Appl. No.: 533,317

[22] Filed: Jun. 5, 1990

[51] Int. Cl.[5] ..... B05D 3/06; B05D 5/12; C01B 00/00

[52] U.S. Cl. ..... 427/53.1; 427/54.1; 427/123; 204/157.4

[58] Field of Search ..... 427/53.1, 54.1, 55, 427/123, 125; 204/157.15, 157.4, 157.41

[56] References Cited

U.S. PATENT DOCUMENTS

| | | | |
|---|---|---|---|
| 3,860,501 | 1/1975 | Gysling | 427/98 |
| 4,009,297 | 2/1977 | Redmond et al. | 427/54.1 |
| 4,046,569 | 9/1977 | Gysling et al. | 427/265 |
| 4,178,180 | 12/1979 | Vinal | 427/265 |
| 4,201,588 | 5/1980 | Adin et al. | 430/199 |
| 4,201,638 | 5/1980 | Wan et al. | 204/157.69 |
| 4,500,569 | 2/1985 | Siedle | 427/304 |

*Primary Examiner*—Shrive Beck
*Assistant Examiner*—Marianne Padgett
*Attorney, Agent, or Firm*—Richard P. Fennelly; Louis A. Morris

[57] ABSTRACT

Metal is photolytically deposited from solution onto a substrate in contact with the solution by irradiating with light a solution containing a solubilized metal and a tetraarylborate compound capable of promoting the photoreduction of the metal onto the substrate.

8 Claims, No Drawings

PHOTOLYTIC DEPOSITION OF METAL FROM SOLUTION ONTO A SUBSTRATE

BACKGROUND OF THE INVENTION

K. A. Jones in "Laser Assisted MOCVD Growth", in *Solid State Technology*, 28(10), 151–156 (1985) indicates that metals can be deposited by allowing molecules to absorb ultraviolet light citing the earlier work of T. F. Deutsch et al. in Appl. Phys. Lett. 1979, 35(2), 175–177. The laser photodeposition of metal films by Deutsch et al. utilized the ultraviolet laser-induced photodissociation of organometallic compounds to yield features smaller than 2 microns. Deutsch et al. use trimethylaluminum and dimethylcadmium as parent gases from which aluminum or cadmium were deposited. They also employed a methyltin and $CF_3I$ to deposit tin and iodine.

U.S. Pat. Nos. 4,559,237 and 4,619,838 indicate that various inorganic metal species in the form of either simple or complex salts can be deposited onto semiconductor powders by means of a photoredox reaction by irradiation of a suspension of a semiconductor powder in the presence of oxygen and, optionally, carbon dioxide in an oxidizable system (e.g., water, an alkanol, an ether, etc.) which protects the semiconductor from photocorrosion.

Japanese Patent Publication Nos. 243279/1985 and 243280/1985 prepare transparent electrodes by forming an electrode-forming solution of a non-hydrolyzable organic metal compound containing indium and tin (e.g., trisacetylacetonatoindium and bis-acetylacetonatodibutyltin), an organic binder (e.g., a cellulose), and a solvent (e.g., a high boiling solvent to form a paste for screen printing or a low boiling solvent for a dipping solution). The desired substrate is treated with the solution and irradiated with ultraviolet radiation. The resulting ozone which is produced causes organic chain decomposition and forced oxidation of the solution thereby facilitating the burning of its organic components so that a film of uniform quality is formed.

Japanese Patent Publication No. 50172/1985 describes dipping an electrically non-conductive substance carrying a semiconductor on its surface into a solution containing metal ions derived from inorganic metal salts. The semiconductor is excitable by visible and/or ultraviolet light. An electron donor can be used to assist in the injection of electrons into the semiconductor when the latter is excited by light and the metal ions are reduced to the metal state. This reference describes the use of electron donor compounds such as ammonia, amines, alcohols, aldehydes, ketones, ethers, sulfoxides and amides to enable the injection of electrons into the semiconductor. Preferred examples are identified as being ammonia, methylamine, methanol, and ethanol.

Japanese Patent Publication No. 133076/1987 describes a process for forming metal-plated inorganic substances by dispersing an inorganic substance in a solution containing ions of a catalytic metal (e.g., derived from palladium chloride) and a reaction assistant (or reducing agent), irradiating the dispersion with light to cause reduction of the ions so that the catalytic metal may be deposited on the surface of the inorganic substance and then plating the surface of the inorganic substance with a metal electrolessly. Various reducing agents are identified as reaction assistants including alcohols, aldehydes, sugars, amines (e.g., ethylamine, benzylamine, and aniline), organic acids, and oxoacid salts containing either phosphorus, sulfur or nitrogen.

A series of publications by Y. L. Chow et al. (e.g., *J. Chem. Soc. Perkin Trans.* II 1986, pp. 365–369 and the citations therein) relate to the photoreduction of bis-(acetylacetonato) copper(II) and nickel (II) using benzene or certain high triplet energy ketones, e.g., xanthen-9-one, benzophenone, or acetophenone.

SUMMARY OF THE INVENTION

The invention relates to the substantially photolytic reduction of metal species contained in solution onto a substrate in contact with the solution using a novel class of photosensitizer that simultaneously functions as a reductant. The photosensitizer-reductant used herein is a tetraarylborate.

DETAILED DESCRIPTION OF THE INVENTION

The instant process involves the formation of an appropriate solution containing dissolved metal species derived from either metal-organic compounds or inorganic salts and a compound capable of promoting the photoreduction of the metal onto a substrate which is in contact with the solution. The term "metal-organic" as used herein is intended to connote species containing metal and organo components. Organometallic compounds containing a direct metal to carbon bond are one class of compounds which may be used.

The solvent which is used for the instant invention is advantageously substantially free of water and free oxygen. Methanol or tetrahydrofuran has proven to be useful. It is within the contemplation of the instant invention to use other alcohols as well as other organic solvents such as ethers, and certain aromatic and aliphatic hydrocarbon solvents (e.g., toluene and hexane).

The dissolved metal species which can be used herein is one which can be selected from a variety of sources. One source are the metal acetylacetonate compounds including those of such transition metals as copper(II), cobalt(II), nickel(II), platinum(II), palladium(II), silver(I), zinc(II), and the like. Another source for the dissolved metal species can be such inorganic metal salts as the soluble halides, sulfates, and the like of such metals as copper, cobalt, iron, nickel, platinum, palladium, silver, zinc, tin, and the like. Generally, the concentration of the metal species can be from about 3 mmol/L to about 50 mmol/L.

The compound responsible for the appropriate promotion of the photoreduction of the foregoing solubilized metal source in the type of solvent medium earlier described is a tetraarylborate compound. The alkali metal tetraarylborates of the general formula $$M^+BAr_4^-$$

where M is an alkali metal (such as sodium) and Ar is substituted or unsubstituted phenyl are within the contemplation of the present invention. Sodium tetraphenylborate is exemplary. Generally, the amount of promoter used can range from about 5 mmol/L to about 50 mmol/L.

The instant invention can be used to deposit metal films and can be used in regard to the following: the resulting highly active metal films can serve as catalysts or stoichiometric reagents for a wide variety of organic chemical reactions, such as the oxidation of alcohols to aldehydes or ketones, the cyclopropanation of olefins with methylene halides, the coupling of aryl halides to biaryls, the intermolecular hydrogen transfer between hydrocarbons and the desulfurization of organosulfur compounds.

The invention is further understood by the Examples which follow.

COMPARATIVE EXAMPLE 1

No tetraarylborate compound was used.

The reaction solution for photochemical copper deposition was prepared by placing 50.0 mL of a saturated solution of copper(II) acetylacetonate in dry, oxygen-free methanol into a quartz tube. The reactor-tube was briefly connected to vacuum, refilled with nitrogen, closed and then placed into the UV-chamber. The contents of the reactor-tube were irradiated at 185–254 nm for 3 hours. After 3 hours the reactor-tube was removed from the UV-chamber. No copper metal film was detected on the inner wall of tube. Irradiation was continued for an additional 15 hours. After a total of 18 hours of irradiation, only a trace of metallic copper deposition was detected.

COMPARATIVE EXAMPLE 2

No tetraarylborate compound was used.

The reaction solution for photochemical copper deposition was prepared by placing 50.0 mL of a saturated solution of copper(II) acetylacetonate in dry, oxygen-free methanol into a quartz tube. The reactor-tube was briefly connected to vacuum, refilled with nitrogen, closed and then placed into the UV-chamber. The contents of the reactor-tube were irradiated at 300 nm for 18 hours. After 18 hours the reactor-tube was removed from the UV-chamber. No trace of copper metal film was detected on the inner wall of tube.

EXAMPLE 3

The reaction solution for photochemical metal film deposition was prepared by placing 0.100 g of copper-(II) acetylacetonate and 0.110 g of sodium tetraphenylborate into a quartz tube. The reactor-tube was briefly connected to vacuum, refilled with nitrogen and closed by rubber septum. Then 10 mL of dry, oxygen free tetrahydrofuran was introduced to the reactor-tube. The reactor-tube was placed in the UV-chamber and irradiated at 254 nm for 18 hours. After 18 hours the reactor-tube was removed from the UV-chamber. A metallic copper film was observed on the inner wall of tube.

EXAMPLE 4

The reaction solution for photochemical metal film deposition was prepared by placing 0.050 g of copper-(II) acetylacetonate and 0.100 g of sodium tetraphenylborate into a quartz tube. Then 10 mL of dry, oxygen-free methyl alcohol was introduced to the reactor-tube. After 18 hours of irradiation by UV light at 185–254 nm, a metallic copper film was observed on the inner wall of tube.

EXAMPLE 5

The reaction solution for photochemical metal film deposition was prepared by placing 0.100 g of cobalt(II) acetylacetonate and 0.110 g of sodium tetraphenylborate into a quartz tube. The rest of procedure was carried out as described in Example 3. After 18 hours, the metallic cobalt film was observed on the inner wall of the tube.

EXAMPLE 6

The reaction solution for photochemial metal film deposition was prepared by placing 0.100 g of nickel(II) acetylacetonate and 0.110 g of sodium tetraphenylborate into a quartz tube. Then 10 mL of dry, oxygen-free tetrahydrofuran was introduced into reactor-tube under an inert atmosphere After 18 hours of irradiation at 254 nm the metallic nickel film was observed on the inner wall of the tube.

EXAMPLE 7

The reaction was carried out as described in Example 6 except that 0.100 g of zinc(II) acetylacetonate was used as the source of metal. The deposition of metallic zinc was observed.

EXAMPLE 8

The reaction solution was prepared as described in Example 6 using 0.040 g of platinum(II) acetylacetonate and 0.070 g of sodium tetraphenylborate. The rest of the procedure was carried out as described in Example 6. The deposition of metallic platinum was observed after 8 hours.

EXAMPLE 9

The reaction was carried out as described in Example 8, except that 0.030 g of palladium(II) acetylacetonate was used instead of platinum. After 8 hours, deposition of metallic palladium was observed.

EXAMPLE 10

The experiment was carried out as described in Example 6 using 10 ml of methyl alcohol instead of tetrahydrofuran. After 18 hours of irradiation at 254 nm the metallic nickel film deposition was observed.

EXAMPLE 11

The reaction solution for photochemical metal film deposition was prepared by placing 0.100 g of copper-(II) bromide and 0.100 g of sodium tetraphenylborate into a quartz tube. Oxygen was removed from the tube by brief connection to vacuum and the tube was refilled with nitrogen. The tube-reactor closed by rubber septum, 10 mL of dry oxygen free tetrahydrofuran was introduced. After 18 hours of irradiation at 254 nm the metallic copper film was observed on the inner wall of the tube.

EXAMPLE 12

The reaction solution was prepared as described in Example 11 using 0.100 g of nickel(II) chloride. The rest of experiment was carried out as described in Example 11. After 8 hours of irradiation at 254 nm the metallic nickel film deposition was observed.

We claim:

1. A process for the substantially photolytic deposition of a metal from solution onto a substrate which comprises irradiation with light to cause said deposition, of a solution formed by combining as separate reagents, (1) metal source selected from the group consisting of a 1,3-dicarbonyl complex of the metal and a soluble inorganic metal salt, and (2) a tetraarylborate compound capable of coordination with the metal species so as to be capable of promoting the photoreduction of the metal onto the substrate when the solution is in contact with the substrate.

2. A process as claimed in claim 1 wherein the solution is substantially anhydrous.

3. A process as claimed in claim 1 wherein the solubilized metal is a 1,3-dicarbonyl complex of the metal.

4. A process as claimed in claim 1 wherein the compound capable of promoting the photoreduction is an alkali metal tetraarylborate.

5. A process as claimed in claim 1 wherein the solution is substantially anhydrous and the solubilized metal is a 1,3-dicarbonyl complex of the metal.

6. A process as claimed in claim 5 wherein the compound capable of promoting the photoreduction is an alkali metal tetraarylborate.

7. A process as claimed in claim 1 wherein the compound capable of promoting the photoreduction is sodium tetraarylborate.

8. A process as claimed in claim 5 wherein the compound is sodium tetraphenylborate.

* * * * *